US011140944B2

(12) United States Patent
Chang et al.

(10) Patent No.: US 11,140,944 B2
(45) Date of Patent: Oct. 12, 2021

(54) MULTI-STYLE MOISTURE-PERMEABLE WATERPROOF SHOE

(71) Applicants: Chung-Hao Chang, Taichung (TW); Chia-Ying Chang, Taichung (TW)

(72) Inventors: Chung-Hao Chang, Taichung (TW); Chia-Ying Chang, Taichung (TW)

( * ) Notice: Subject to any disclaimer, the term of this patent is extended or adjusted under 35 U.S.C. 154(b) by 106 days.

(21) Appl. No.: 16/587,772

(22) Filed: Sep. 30, 2019

(65) Prior Publication Data

US 2020/0405005 A1 Dec. 31, 2020

(30) Foreign Application Priority Data

Jun. 28, 2019 (TW) ..... 108122823

(51) Int. Cl.
*A43B 7/12* (2006.01)
*A43B 23/02* (2006.01)
*A43B 3/24* (2006.01)

(52) U.S. Cl.
CPC ..... *A43B 7/125* (2013.01); *A43B 3/24* (2013.01); *A43B 23/0235* (2013.01)

(58) Field of Classification Search
CPC ..... A43B 7/125; A43B 3/24; A43B 23/0235; A43B 23/07
USPC ..... 36/100, 55, 10
See application file for complete search history.

(56) References Cited

U.S. PATENT DOCUMENTS 5,499,459 A * 3/1996 Tomaro ..... A43B 1/0045 36/10
5,964,047 A * 10/1999 Covatch ..... A43B 7/34 36/10
7,421,806 B2 * 9/2008 Braynock ..... A43B 1/0036 2/239
2003/0093919 A1 * 5/2003 Wang ..... A43B 19/00 36/10
2003/0167656 A1 * 9/2003 Tung ..... A43B 23/07 36/55
2003/0200679 A1 * 10/2003 Wilson ..... A43B 9/12 36/55
2007/0062067 A1 * 3/2007 Covatch ..... A43B 3/24 36/55
2008/0250670 A1 * 10/2008 Lefebvre ..... A43B 13/18 36/102
2009/0100713 A1 * 4/2009 Adami ..... A43B 5/02 36/100
2011/0000106 A1 * 1/2011 Baychar ..... A43B 5/049 36/3 R
2011/0023325 A1 * 2/2011 Wines ..... A43B 3/242 36/100
2015/0237960 A1 * 8/2015 Mallen ..... A43B 23/0255 36/55

(Continued)

*Primary Examiner* — Marie D Bays

(57) ABSTRACT

A multi-style moisture-permeable waterproof shoe includes an outer shoe body unit defining an insertion space, and a plurality of sock-like inner shoe body units inserted removably and selectively into the insertion space. Each sock-like inner shoe body unit includes a moisture-permeable waterproof shoe-like inner sleeve and an outer sock body. The shoe-like inner sleeve defines a foot space and is made from at least one cut piece. The outer sock body has a sock body portion sleeved on the shoe-like inner sleeve. An inner adhesive layer is adhered between an outer surface of the shoe-like inner sleeve and an inner surface of the sock body portion.

10 Claims, 14 Drawing Sheets

(56) References Cited

U.S. PATENT DOCUMENTS

2015/0245688 A1* 9/2015 Young ..... A43B 3/10
36/10

* cited by examiner

MULTI-STYLE MOISTURE-PERMEABLE WATERPROOF SHOE

CROSS-REFERENCE TO RELATED APPLICATION

This application claims priority to Taiwanese Patent Application No. 108122823, filed on Jun. 28, 2019.

FIELD

The disclosure relates to a shoe, more particularly to a moisture-permeable waterproof shoe that can be changed to different styles.

BACKGROUND

Referring to FIG. 1, a conventional sock shoe includes an upper 1 and a sole 2 fixed to the upper 1. In comparison with the traditional shoes (such as leather shoes), this kind of sock shoes can provide better wearability. However, just like the traditional shoes, the appearance of the conventional sock shoe is fixed and cannot be changed. If the user intends to dress up in a different style, he/she can only change to another pair of sock shoes. Further, since the upper 1 is generally made of a soft simple woven material that does not have stiffness, the upper 1 cannot support a three-dimensional shape corresponding to the user's foot. Therefore, when the conventional sock shoe is not worn, the upper 1 usually collapses inwardly and presents a flat wrinkled shape; and when the user wears the conventional sock shoe, it is similar to wearing an ordinary sock in which he/she has to extend his/her fingers inside the flat-shaped upper 1 and then pull open the upper 1 so as to insert his/her foot inside the upper 1. Thus, the conventional sock shoe cannot be quickly worn, and is inconvenient to use.

SUMMARY

Therefore, an object of the present disclosure is to provide a multi-style moisture-permeable waterproof shoe that is capable of alleviating at least one of the drawbacks of the prior art.

Accordingly, a multi-style moisture-permeable waterproof shoe of this disclosure includes an outer shoe body unit defining an insertion space that has an open top end and a closed bottom end, and a plurality of sock-like inner shoe body units inserted removably and selectively into the insertion space of the outer shoe body unit. Each sock-like inner shoe body unit includes a moisture-permeable waterproof shoe-like inner sleeve, an outer sock body and an inner adhesive layer. The moisture-permeable waterproof shoe-like inner sleeve defines a foot space that has an open top end and a closed bottom end and is made from at least one cut piece. The outer sock body has a sock body portion sleeved on the moisture-permeable waterproof shoe-like inner sleeve. The inner adhesive layer is adhered between an outer surface of the moisture-permeable waterproof shoe-like inner sleeve and an inner surface of the sock body portion.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
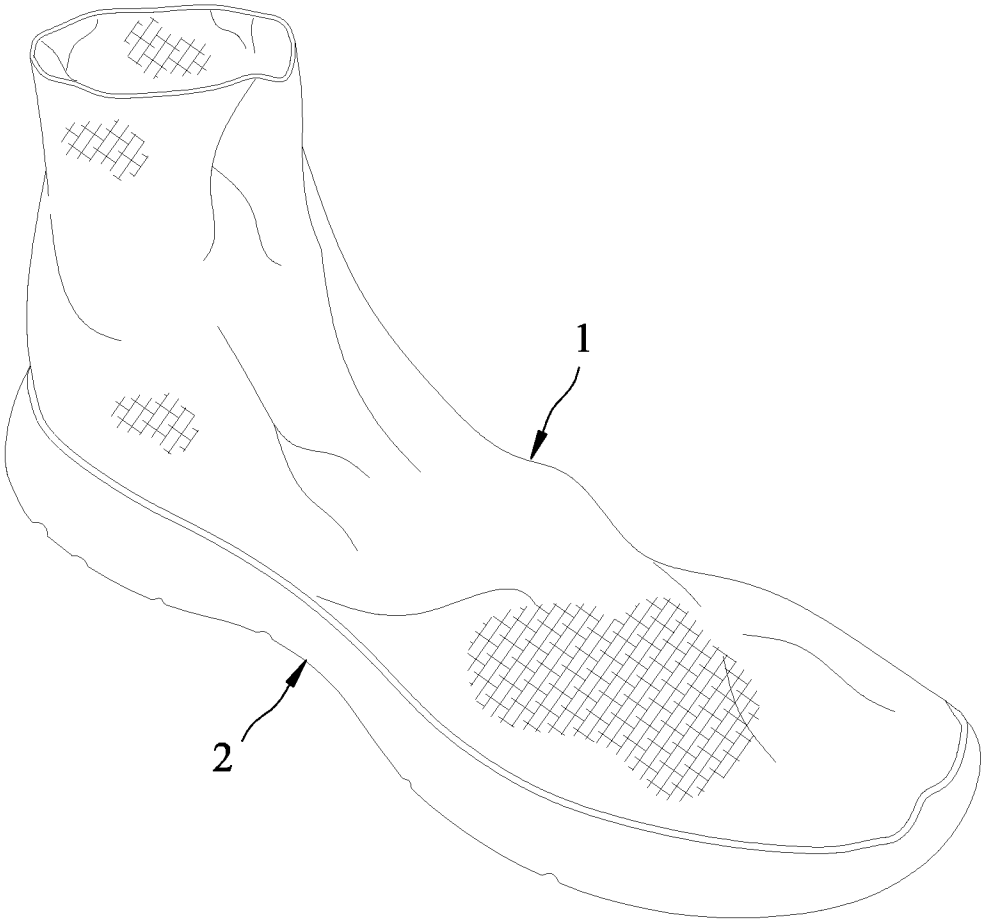
FIG.1 PRIOR ART
FIG. 1 is a perspective view of a conventional sock shoe.

Before the present disclosure is described in greater detail with reference to the accompanying embodiments, it should be noted herein that like elements are denoted by the same reference numerals throughout the disclosure.

Figure 2:
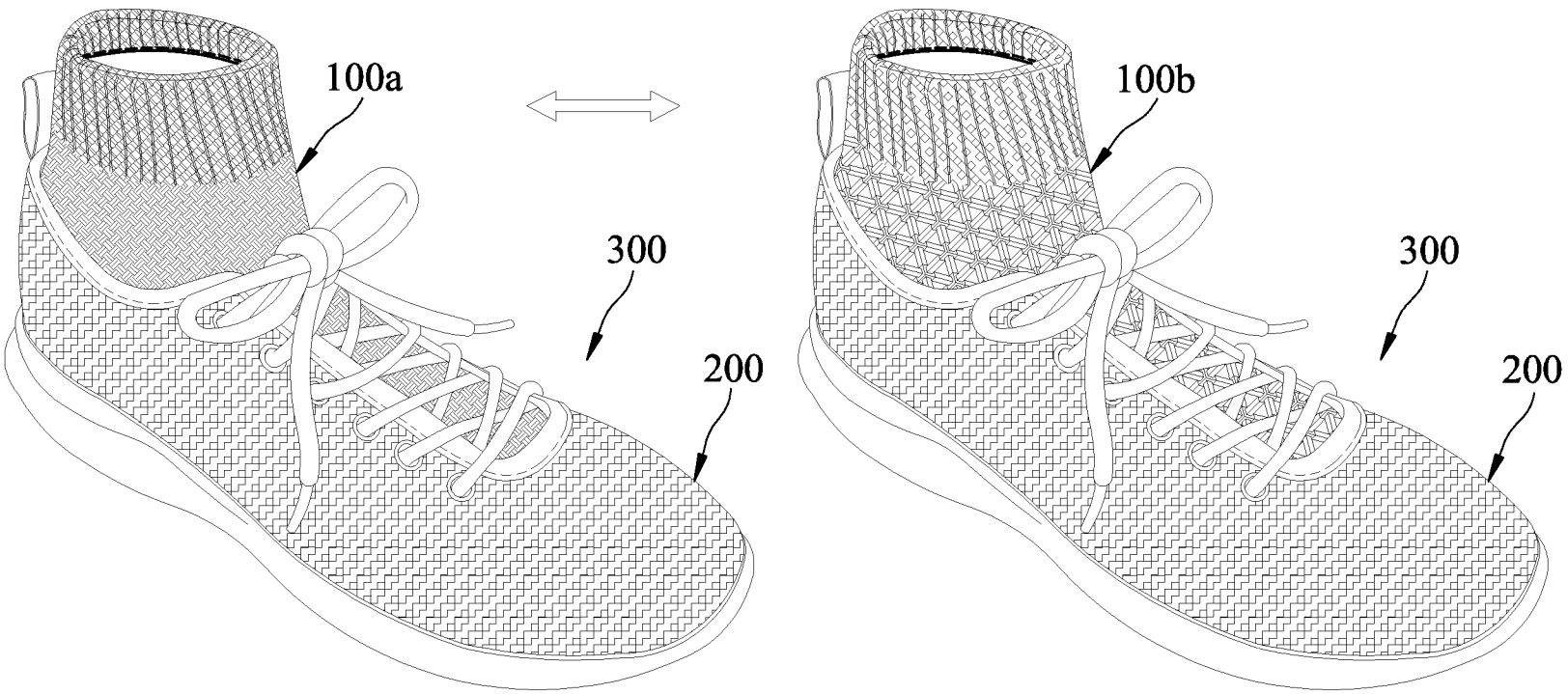
FIG. 2 is a perspective view of two different styles of a moisture-permeable waterproof shoe according to the first embodiment of the present disclosure.

FIG. 2 illustrates two different styles of a moisture-permeable waterproof shoe 300 according to the first embodiment of the present disclosure. Referring to FIGS. 3 to 7, the moisture-permeable waterproof shoe 300 of this embodiment includes two sock-like inner shoe body units (100*a*, 100*b*) and an outer shoe body unit 200.

Figure 4:
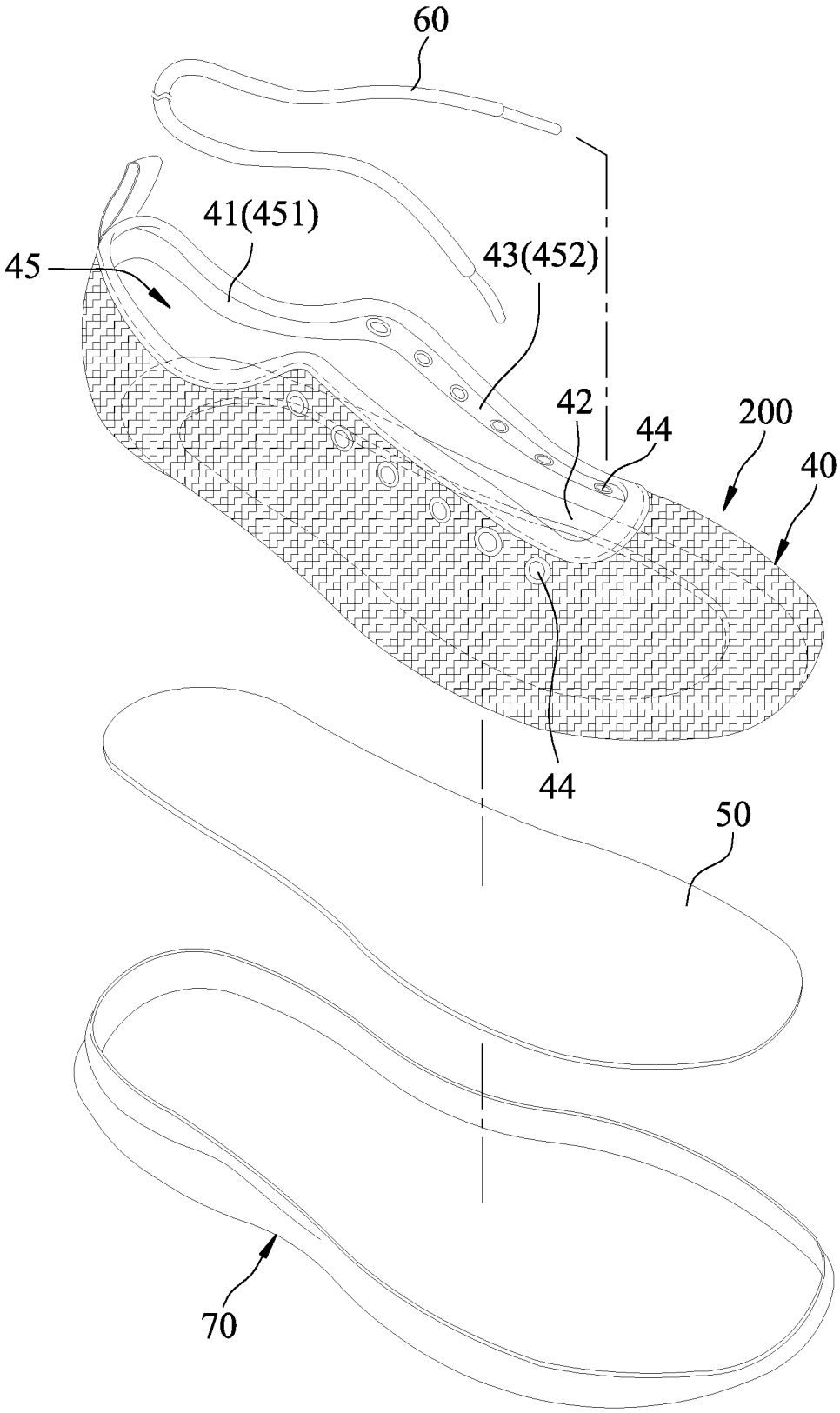
FIG. 4 is an exploded perspective view of the outer shoe body unit of the first embodiment.
Figure 6:
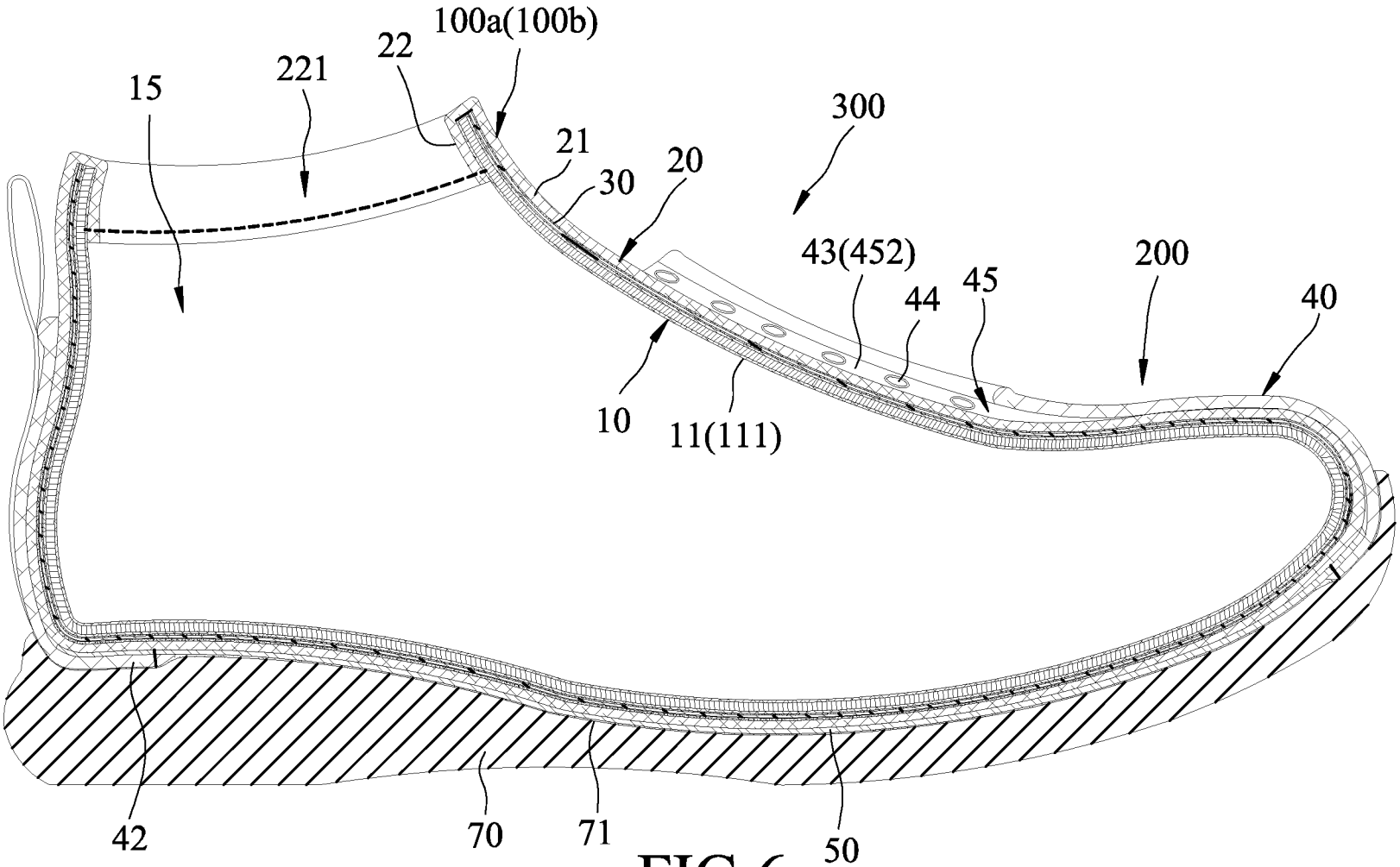
FIG. 6 is an assembled sectional side view of the first embodiment, but without a shoelace.
Figure 7:
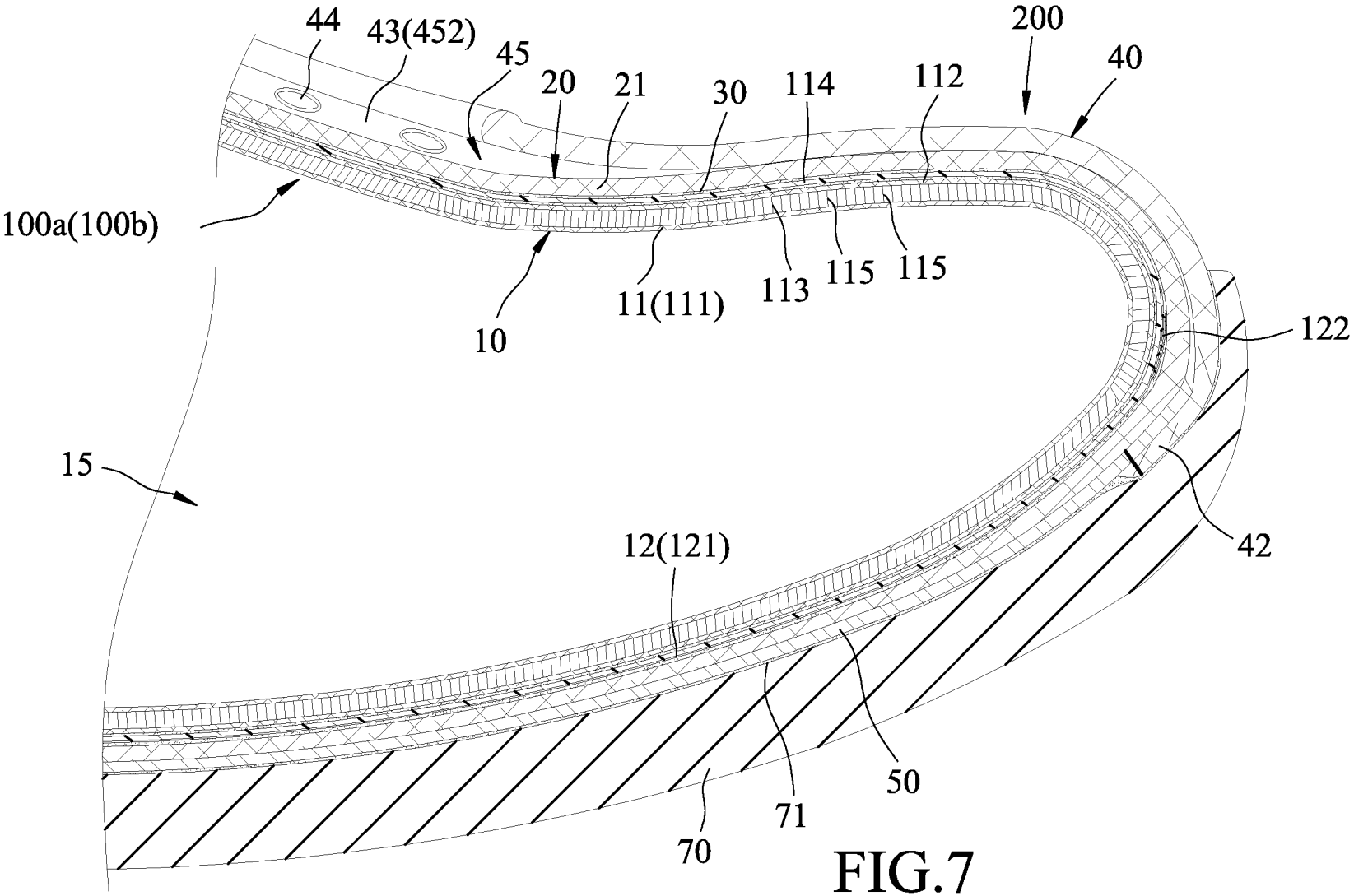
FIG. 7 is an enlarged fragmentary sectional side view of FIG. 6.

The outer shoe body unit 200 includes an outer shoe upper 40, a midsole 50, a shoelace 60, an outsole 70, and an outer adhesive layer 71 (see FIG. 7). As shown in FIGS. 4, 6 and 7, the outer shoe upper 40 has an ankle opening edge 41, a bottom opening edge 42, an instep edge 43 connected to the ankle opening edge 41, and a plurality of lace holes 44 arranged in pairs on two opposite sides of the instep edge 43. The outer shoe upper 40 and the midsole 50 cooperate with each other to define an insertion space 45 having an open top end and a closed bottom end. The insertion space 45 has an insertion opening 451 surrounded by the ankle opening edge 41, and an instep opening 452 surrounded by the instep edge 43 and communicating with the insertion opening 451. The outer shoe upper 40 may be a knitted shoe upper or a leather shoe upper.

The midsole 50 is fixed to a bottom end of the outer shoe upper 40. In this embodiment, the bottom opening edge 42 extends to a bottom surface of the midsole 50, and is sewn to the midsole 50. In other variations of this embodiment, the bottom opening edge 42 may be adhered to the bottom surface of the midsole 50.

The shoelace 60 is removably threaded through the lace holes 44.

The outsole 70 is also fixed to the bottom opening edge 42 of the outer shoe upper 40. The outer adhesive layer 71 is adhered between the bottom opening edge 42 of the outer shoe upper 40 and a top surface of the outsole 70 and between the bottom surface of the midsole 50 and the top surface of the outsole 70, so that the outsole 70 is fixed to the bottom opening edge 42 of the outer shoe upper 40 and the bottom surface of the midsole 50.

Figure 3:
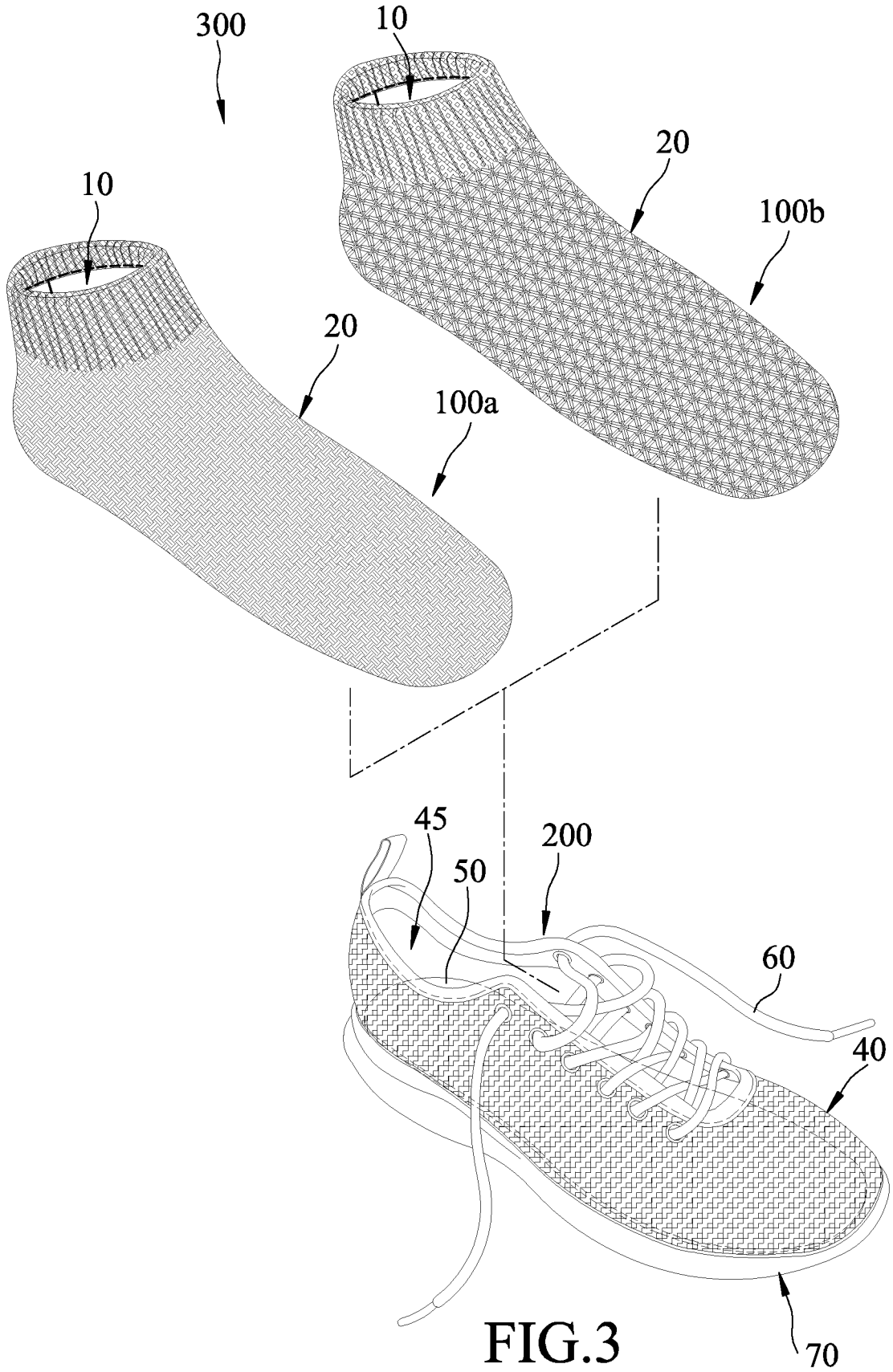
FIG. 3 is an exploded perspective view of an outer shoe body unit and two sock-like inner shoe body units of the first embodiment.

With reference to FIGS. 3, 4 and 6, a method of making the outer shoe body unit 200 is summarized below, but is not limited thereto. The steps involved in the method of making the outer shoe body unit 200 are as follows:

(1) sewing together the bottom opening edge 42 of the outer shoe upper 40 and the midsole 50;

(2) sleeving the assembly of the outer shoe upper 40 and the midsole 50 on a shoe last (not shown);

(3) adhering fixedly the outsole 70 to the bottom opening edge 42 of the outer shoe upper 40 and the midsole 50; and (4) removing the shoe last from the assembly of the outer shoe upper 40 and the midsole 50.

With reference to FIGS. 2 and 3, the sock-like inner shoe body units (100*a*, 100*b*) are inserted removably and selectively into the insertion space 45 through the insertion opening 451. Each of the sock-like inner shoe body units (100*a*, 100*b*) includes a moisture-permeable waterproof shoe-like inner sleeve 10, a waterproof unit 12, an outer sock body 20 and an inner adhesive layer 30 (see FIG. 7). The sock-like inner shoe body units (100*a*, 100*b*) have the same structures, however, a weave pattern of the outer sock body 20 of one of the sock-like inner shoe body units (100*a*, 100*b*) is different from a weave pattern of the outer sock body 20 of the other sock-like inner shoe body unit (100*a*, 100*b*). It should be noted herein that, in other variations of this embodiment, the number of the sock-like inner shoe body units (100*a*, 100*b*) may be more than two, and the colors of the outer sock bodies 20 of the sock-like inner shoe body units (100*a*, 100*b*) may be different.

Figure 5:
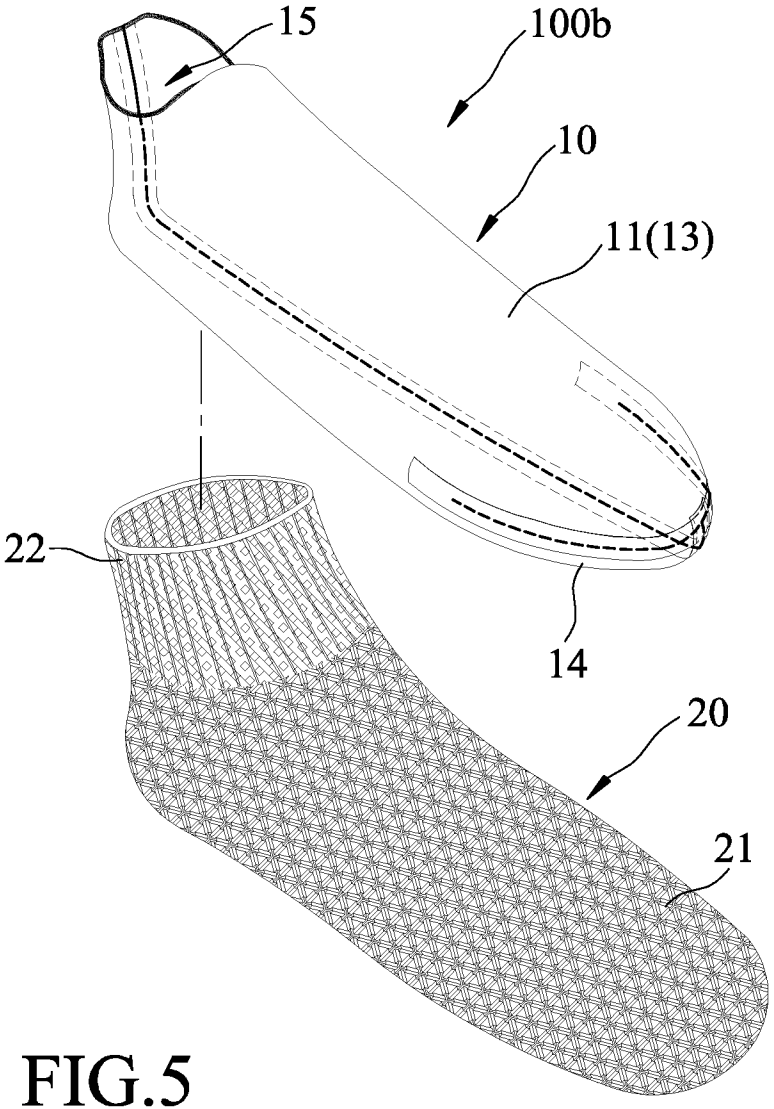
FIG. 5 is an exploded perspective view of each of the sock-like inner shoe body units of the first embodiment.
Figure 5:
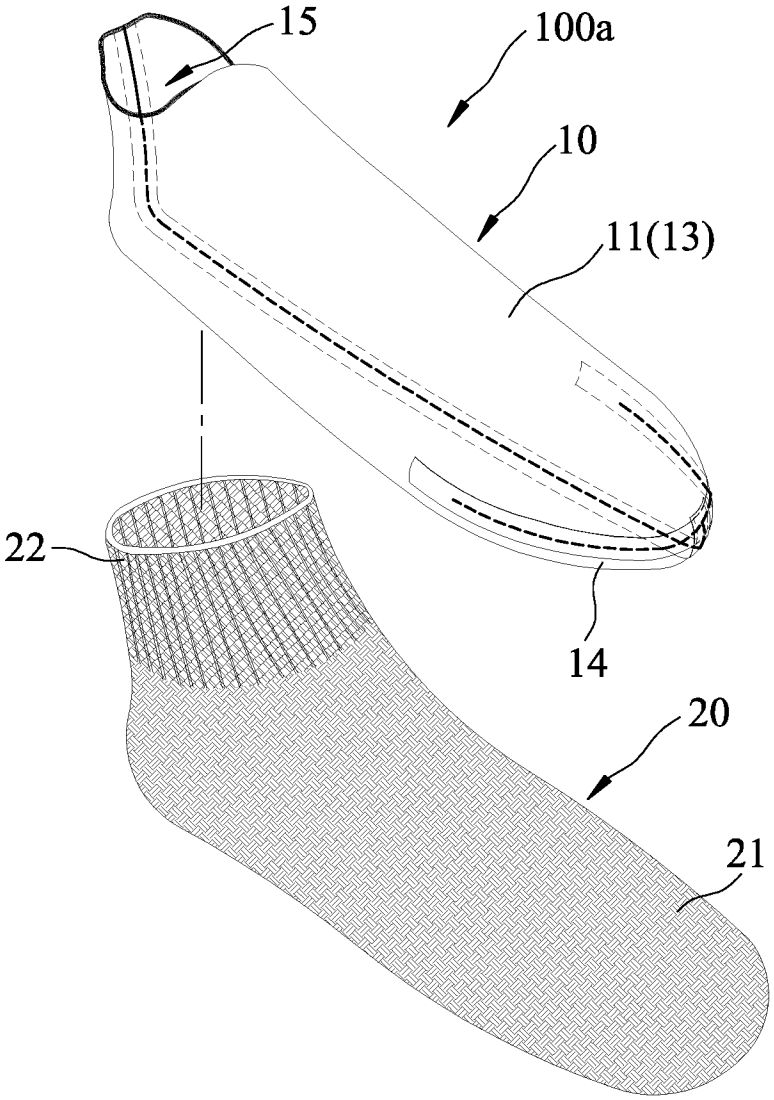

Referring to FIGS. 8 to 11, in combination with FIGS. 5 to 7, the moisture-permeable waterproof shoe-like inner sleeve 10 defines a foot space 15 having an open top end and a closed bottom end, and is made from a cut piece 11 which includes a lining layer 111, an outer fabric layer 112, an upright velvet layer 113 and a moisture-permeable waterproof layer 114. The upright velvet layer 113 has a plurality of spaced-apart pile yarns 115 woven between the lining layer 111 and the outer fabric layer 112. In this embodiment, the stiffness of the upright velvet layer 113 is used to support a three-dimensional shape of the moisture-permeable waterproof shoe-like inner sleeve 10. The moisture-permeable waterproof layer 114 is fixed to an outer surface of the outer fabric layer 112.

The cut piece 11 has a main body 13, and two wing portions 14 symmetrically disposed on two opposite sides of the main body 13 and integrally connected as one piece with the main body 13. The main body 13 has a front convex portion 131 and a rear concave portion 132 opposite to the front convex portion 131. Each of the front convex portion 131 and the rear concave portion 132 has two opposite ends.

Each wing portion 14 includes a wing lateral edge 141 spaced apart from the main body 13 and having a front end and a rear end, a front curved edge 142 connected between the front end of the wing lateral edge 141 and a corresponding one of the two opposite ends of the front convex portion 131, and a rear mating edge 143 connected between the rear end of the wing lateral edge 141 and a corresponding one of the two opposite ends of the rear concave portion 132.

In this embodiment, the front curved edges 142 of the wing portions 14 are connected by sewing to a periphery of the front convex portion 131 of the main body 13, the wing lateral edges 141 of the wing portions 14 are connected by sewing to each other, and the rear mating edges 143 of the wing portions 14 are also connected by sewing to each other, thereby forming the shoe-like inner sleeve 10. The front curved edge 142 of each wing portion 14 has an arc length substantially equal to one half of an arc length of the front convex portion 131.

It should be noted herein that, in other variations of this embodiment, the front curved edge 142 of each wing portion 14 may be ultrasonically welded to the periphery of the front convex portion 131 of the main body 13, the wing lateral edges 141 of the wing portions 14 may be ultrasonically welded to each other, and the rear mating edges 143 of the wing portions 14 may be ultrasonically welded to each other.

The waterproof unit 12 is fixedly connected to the moisture-permeable waterproof layer 114 (see FIG. 7) opposite to the outer fabric layer 112, and covers the moisture-permeable waterproof layer 114 at positions corresponding to the junction of the front curved edges 142 and the periphery of the front convex portion 131, the junction of the wing lateral edges 141, and the junction of the rear mating edges 143.

The waterproof unit 12 includes a first waterproof strip 121 and two second waterproof strips 122. The first waterproof strip 121 extends from the front end to the rear end of the shoe-like inner sleeve 10, as shown in FIG. 11, and is fixedly connected to and covers the moisture-permeable waterproof layer or outer surface 114 of the shoe-like inner sleeve 10 at a position corresponding to the junction of the wing lateral edges 141 and the junction of the rear mating edges 143 of the wing portions 14.

Figure 11:
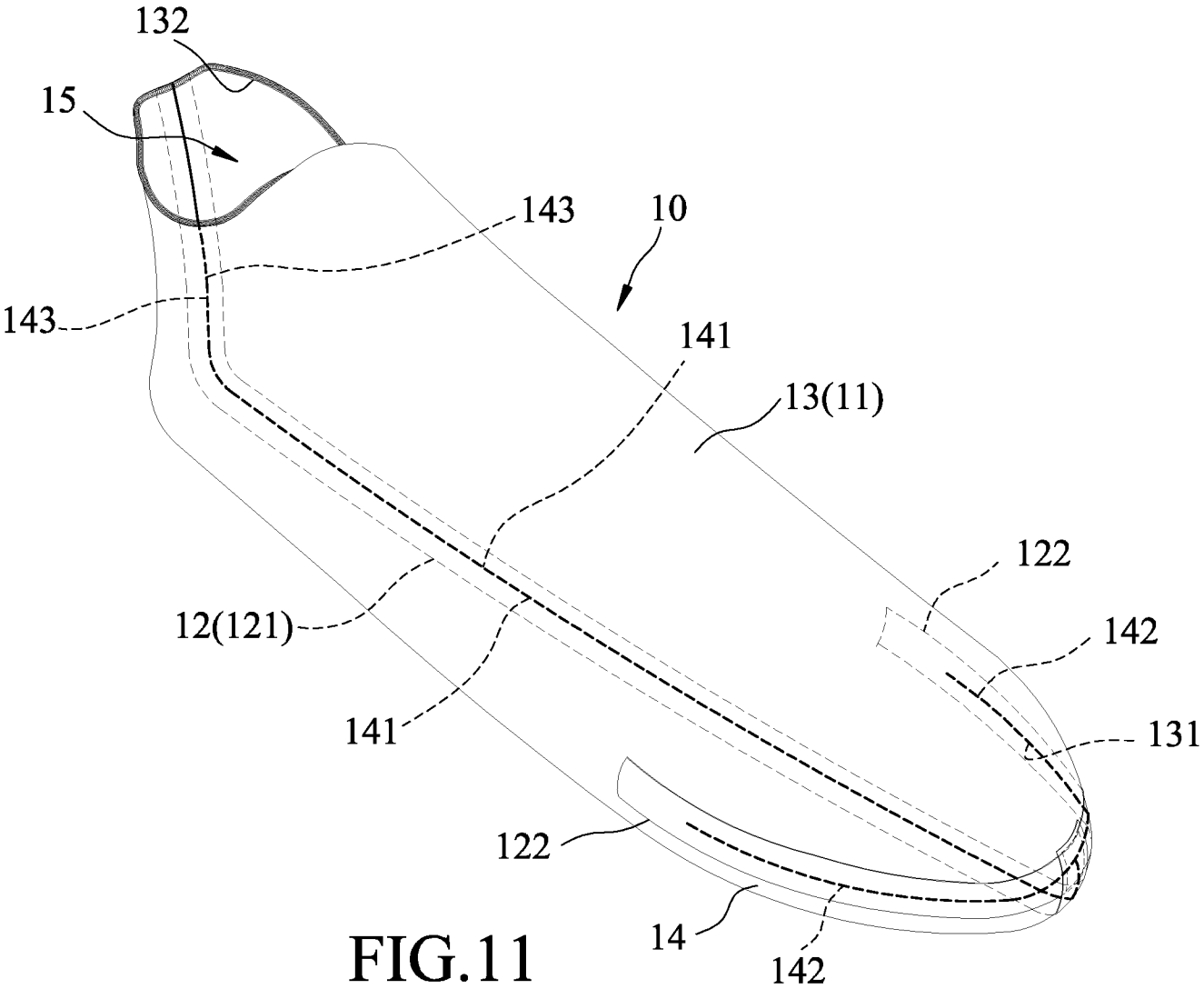
FIG. 11 is a view similar to FIG. 10, but illustrating how a waterproof unit covers the seams of the moisture-permeable waterproof shoe-like inner sleeve.

Each second waterproof strip 122 is fixedly connected to and covers the outer surface 114 of the shoe-like inner sleeve 10 at a position corresponding to the junction of the front curved edge 142 of each wing portion 14 and the periphery of the front convex portion 131, as shown in FIGS. 7 and 11. The second waterproof strips 122 interlace with a front end of the first waterproof strip 121.

Referring back to FIGS. 5 to 7, the outer sock body 20 has a sock body portion 21 sleeved on the shoe-like inner sleeve 10, and a cuff portion 22 that is elastic and that extends upwardly from a top end of the sock body portion 21, that is then folded inwardly and downwardly over a top peripheral portion of the shoe-like inner sleeve 10 toward the foot space 15 of the shoe-like inner sleeve 10. That is, the cuff portion 22 surrounds the top peripheral portion of the shoe-like inner sleeve 10. The cuff portion 22 is fixed to the lining layer 111 of the shoe-like inner sleeve 10, and defines an entry opening 221 communicating with the foot space 15. In this embodiment, the cuff portion 22 is sewn to the lining layer 111. Further, the sock body portion 21 is knitted, but is not limited thereto.

The inner adhesive layer 30 is adhered between an outer surface of the shoe-like inner sleeve 10 and an inner surface of the sock body portion 21, so that the shoe-like inner sleeve 10 and the sock body portion 21 tightly abut against each other. In this embodiment, the inner adhesive layer 30 is a hot melt adhesive, but is not limited thereto.

Figure 8:
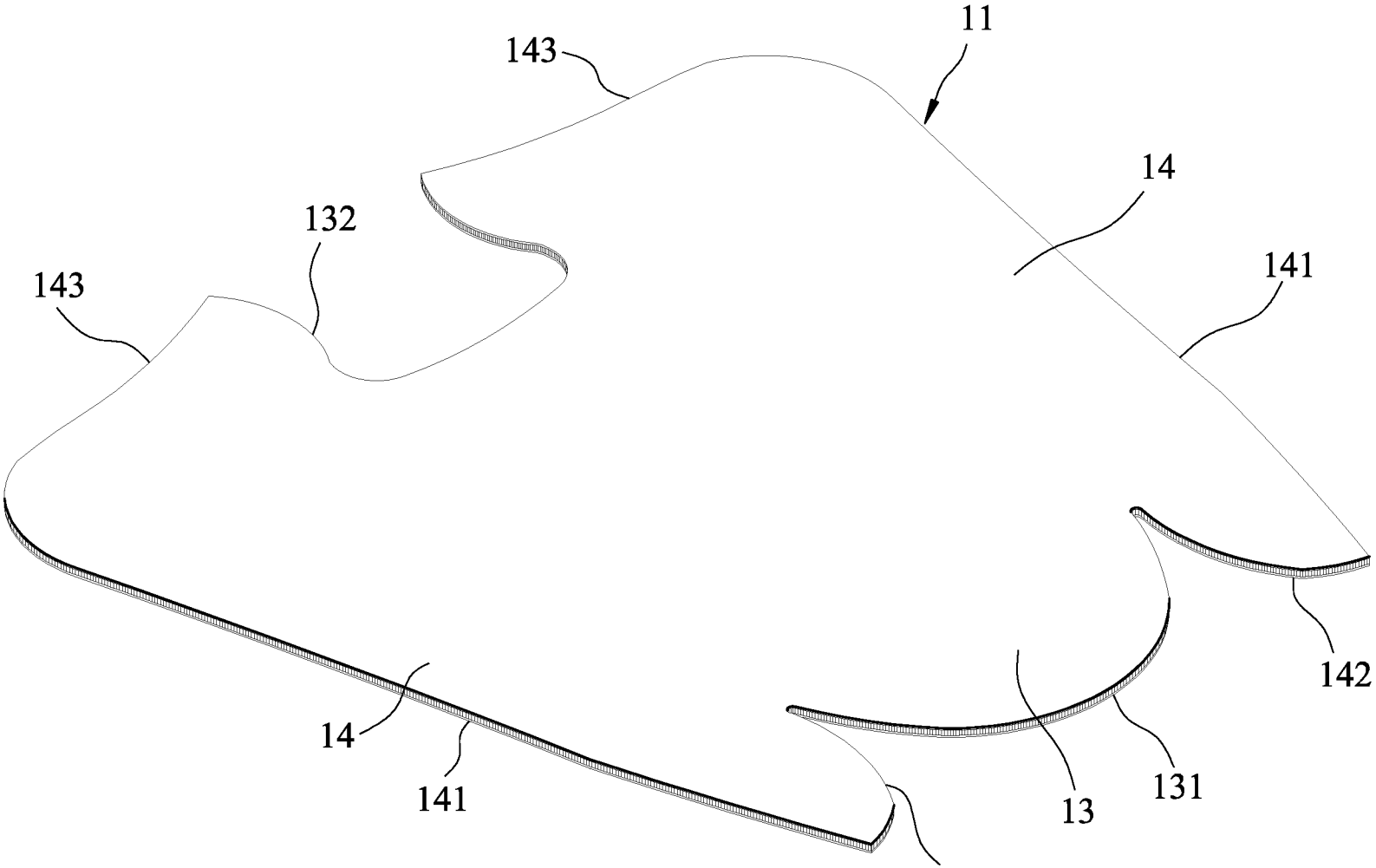
FIG. 8 is a perspective view of a cut piece for forming a moisture-permeable waterproof shoe-like inner sleeve of one of the sock-like inner shoe body units of the first embodiment.
Figure 9:
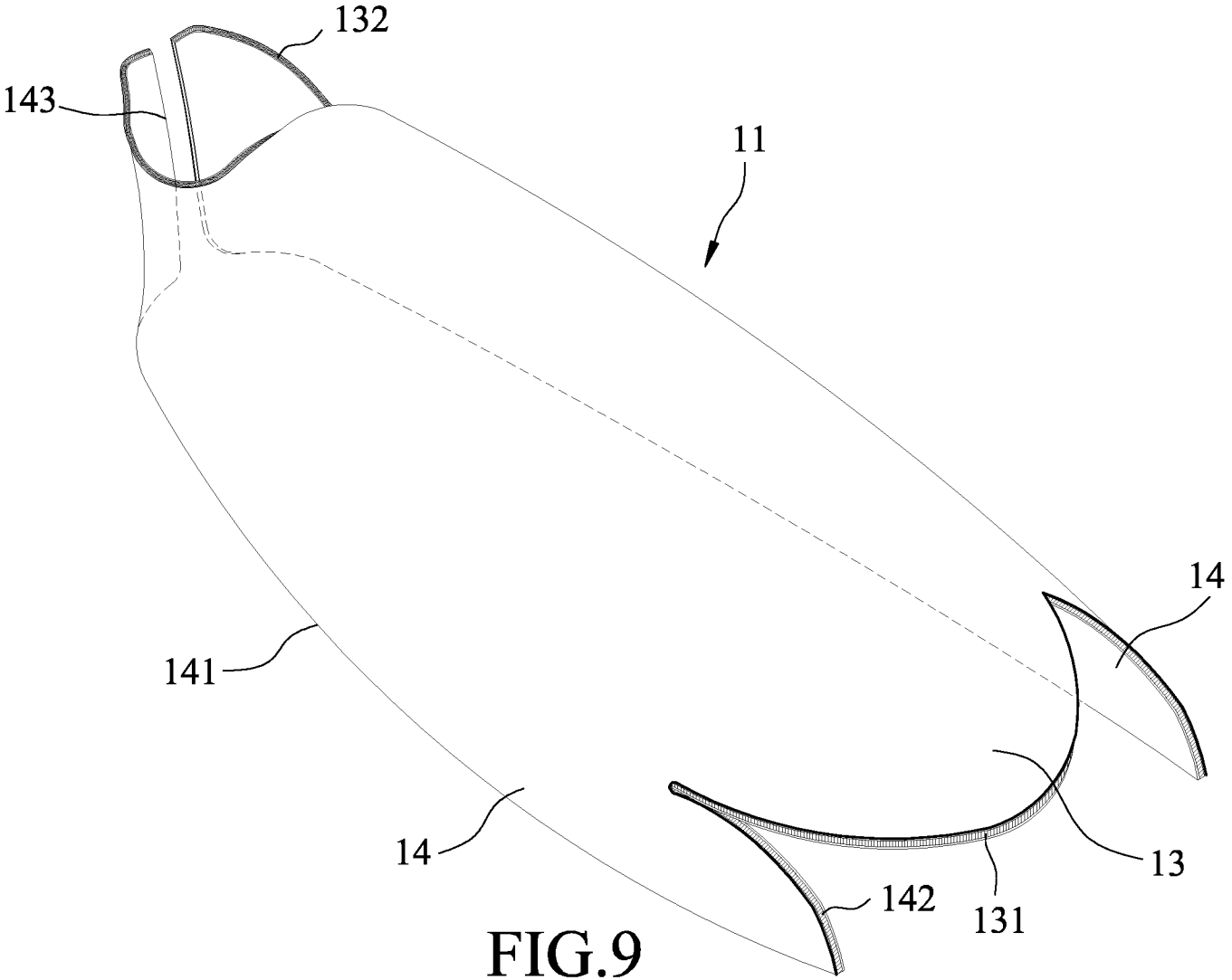
FIG. 9 illustrates the cut piece being folded.
Figure 10:
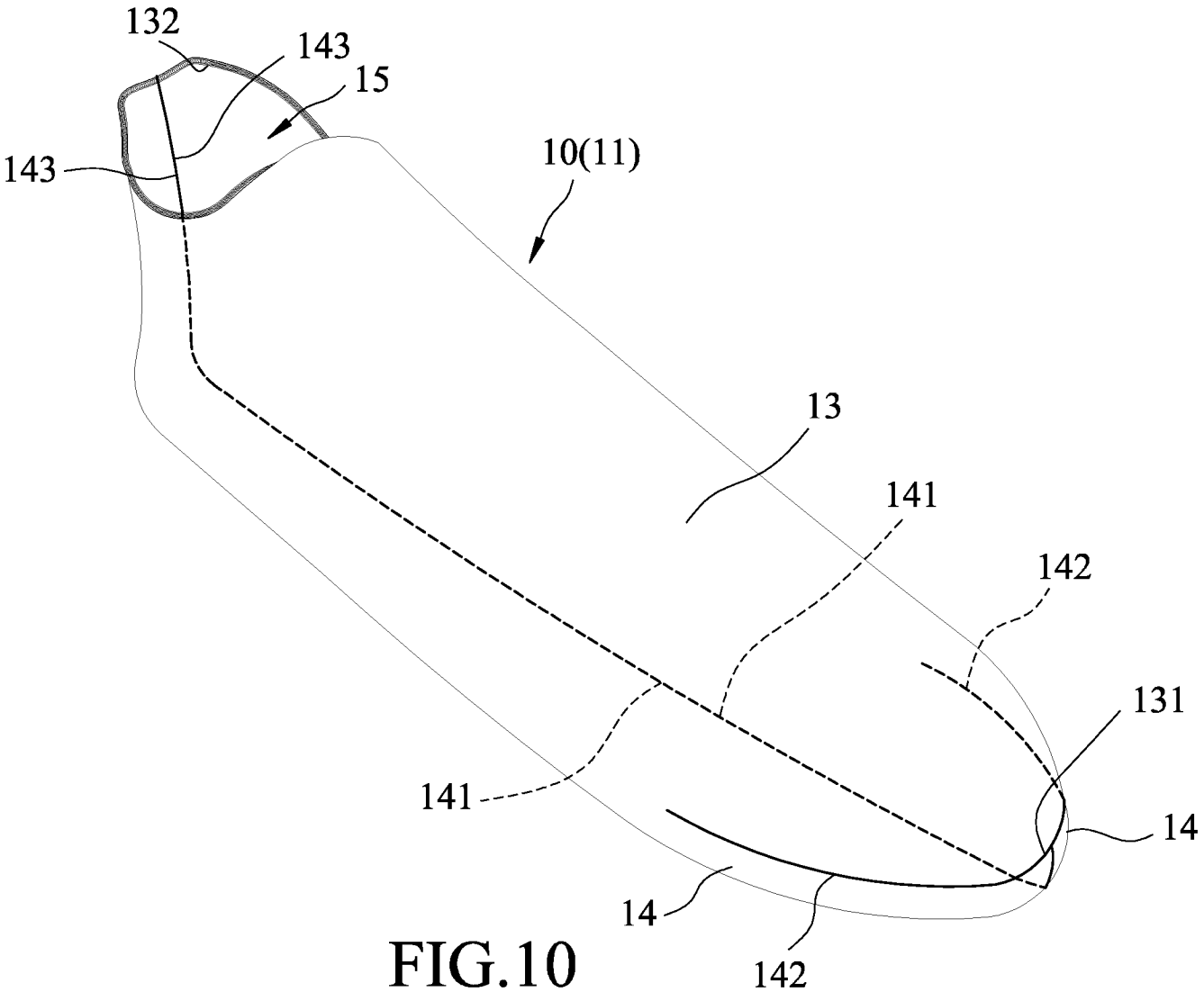
FIG. 10 illustrates how different parts of the cut piece are interconnected by sewing to form the moisture-permeable waterproof shoe-like inner sleeve.

Referring back to FIGS. 3, 5 and 6, a method of making each sock-like inner shoe body unit (100*a*, 100*b*) is summarized below, but is not limited thereto. The steps involved in the method of making each sock-like inner shoe body unit (100*a*, 100*b*) are as follows:

(1) adhering a moisture-permeable waterproof membrane (not shown) on an outer surface of a fabric material (not shown) having a three-layer structure using an adhesive;

(2) cutting the fabric material to obtain the cut piece 11 (see FIG. 8);

(3) sewing the cut piece 11 into a three-dimensional shape to form the shoe-like inner sleeve 10 (see FIG. 10);

(4) adhering the first waterproof strip 121 (see FIG. 11) and the second waterproof strips 122 (see FIG. 11) to the seams of the shoe-like inner sleeve 10 so as to form the shoe-like inner sleeve 10 having moisture-permeable and waterproof functions;

(5) sleeving the moisture-permeable waterproof shoe-like inner sleeve 10 on a shoe last (not shown);

(6) spray coating an adhesive layer to the outer surface of the moisture-permeable waterproof shoe-like inner sleeve 10;

(7) spray coating an adhesive layer to the inner surface of the sock body portion 21 of the outer sock body 20;

(8) sleeving the outer sock body 20 on the moisture-permeable waterproof shoe-like inner sleeve 10;

(9) heating the assembly of the outer sock body 20 and the moisture-permeable waterproof shoe-like inner sleeve 10 to more than 80° C. for 2 to 10 minutes, so that the outer sock body 20 and the shoe-like inner sleeve 10 can be fixedly adhered to each other;

(10) removing the shoe last from the assembly of the outer sock body 20 and the moisture-permeable waterproof shoe-like inner sleeve 10; and

(11) folding the cuff portion 22 of the outer sock body 20 inwardly and downwardly over the top peripheral portion of the shoe-like inner sleeve 10 toward the foot space 15 of the shoe-like inner sleeve 10, and sewing the cuff portion 22 to the lining layer 111 of the moisture-permeable waterproof shoe-like inner sleeve 10.

Referring back to FIGS. 2 and 3, in use, a user can selectively insert one of the sock-like inner shoe body units (100*a*, 100*b*) into the insertion space 45 of the outer shoe body unit 200 to form a moisture-permeable waterproof shoe 300 that can match his/her different style of outfit.

From the aforesaid description, the advantages of this disclosure can be summarized as follows:

(1) In comparison with the prior art, the sock-like inner shoe body units (100*a*, 100*b*) of this disclosure are designed to be inserted removably and selectively into the insertion space 45 of the outer shoe body unit 200 so as to form a moisture-permeable waterproof shoe 300 that can match his/her different style of outfit. Hence, the moisture-permeable waterproof shoe 300 of this disclosure is flexible to use, so that there is no need for the user to change between different shoes. Further, with each sock-like inner shoe body unit (100*a*, 100*b*) cooperating with the outer shoe body unit 200, the moisture-permeable waterproof shoe 300 can present a three-dimensional appearance.

(2) In comparison with the prior art, the sock-like inner shoe body units (100*a*, 100*b*) of this disclosure can use the stiffness of the upright velvet layer 113 to support the three-dimensional shape thereof, so that when the shoe-like inner sleeve 10 is inserted into the outer sock body 20, the outer sock body 20 will not collapse, thereby facilitating quick insertion of the user's foot into the foot space 15 of the shoe-like inner sleeve 10. Thus, convenience and comfort in wearing the moisture-permeable waterproof shoe 300 of this disclosure can be improved.

(3) Since the elastic cuff portion 22 of the outer sock body 20 is folded inwardly and downwardly over the top peripheral portion of the shoe-like inner sleeve 10 toward the foot space 15 of the shoe-like inner sleeve 10 and is sewn to the lining layer 111 of the shoe-like inner sleeve 10, the cuff portion 22 can cover the top peripheral portion of the shoe-like inner sleeve 10. By using the cuff portion 22, the number of components required for sewing in each of the sock-like inner shoe body units (100*a*, 100*b*) can be reduced, thereby lowering the manufacturing costs. Moreover, each of the sock-like inner shoe body units (100*a*, 100*b*) can present an integral appearance, thereby improving the overall appearance of the moisture-permeable waterproof shoe 300.

(4) The moisture-permeable waterproof shoe-like inner sleeve 10 of each sock-like inner shoe body unit (100*a*, 100*b*) of this disclosure uses the cooperation of the moisture-permeable waterproof layer 114 with the first waterproof strip 121 and the second waterproof strips 122 to effectively prevent penetration of water into an interior of the moisture-permeable waterproof shoe-like inner sleeve 10, thereby providing a good waterproof effect to the user's foot. Further, the moisture-permeable waterproof layer 114 can permit the moisture to discharge outwardly to keep the user's foot dry.

(5) The upright velvet layer 113 of the moisture-permeable waterproof shoe-like inner sleeve 10 of each sock-like inner shoe body unit (100*a*, 100*b*) of this disclosure has good elasticity to facilitate smooth insertion of the user's foot into the shoe-like inner sleeve 10. Further, the upright velvet layer 113 also has good air permeability to effectively enhance the comfort of wearing the moisture-permeable waterproof shoe 300. Moreover, the upright velvet layer 113 is woven between the lining layer 111 and the outer fabric layer 112 to form an integral structure, so that the upright velvet layer 113 cannot be easily separated therefrom.

Figure 12:
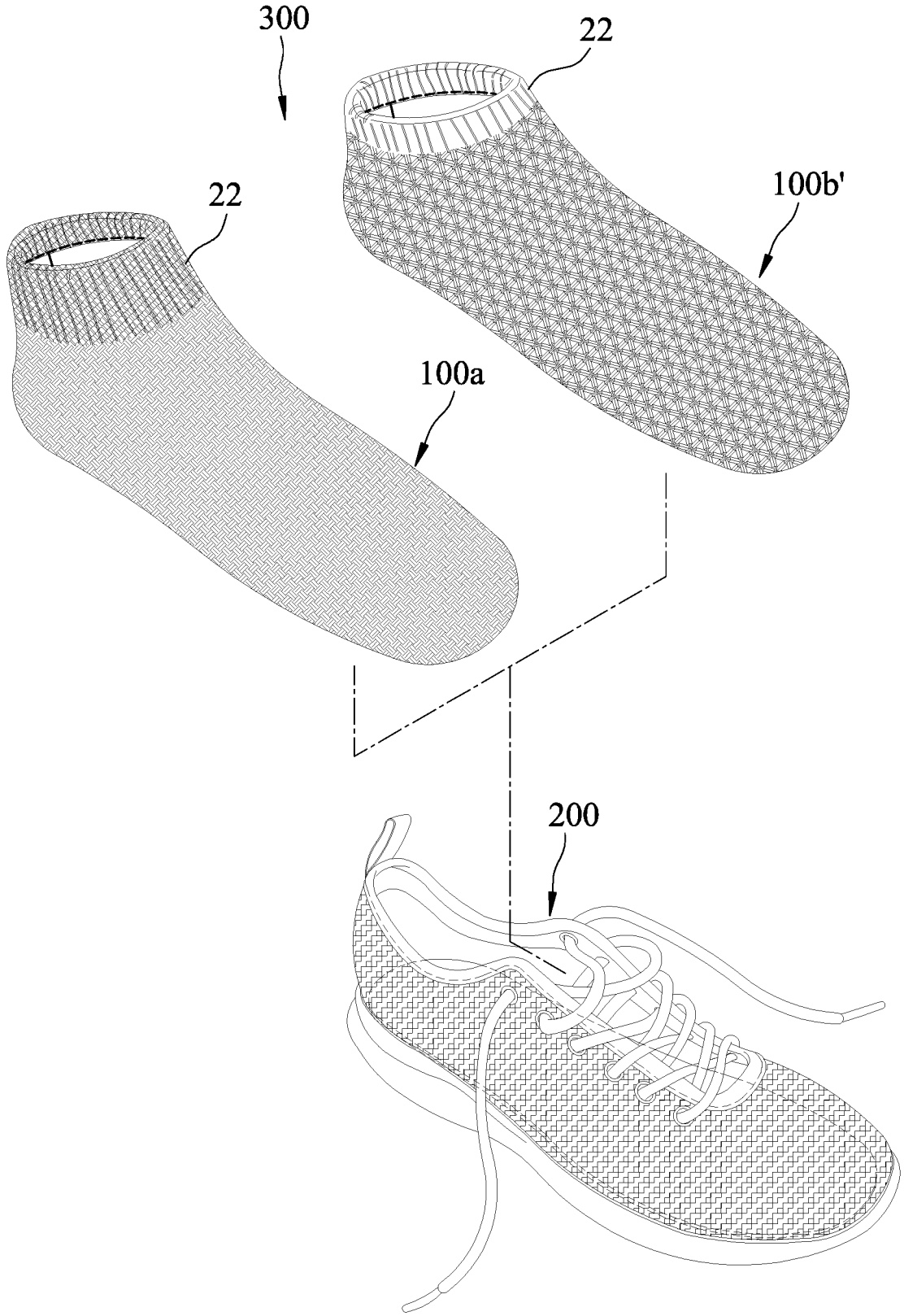
FIG. 12 is a view similar to FIG. 3, but illustrating an alternative form of one of the sock-like inner shoe body units of the first embodiment.

Referring to FIG. 12, it is worth to mention herein that, in other variations of this embodiment, a height and a structure of the cuff portion 22 of the sock-like inner shoe body unit (100*b*') may be different from a height and a structure of the cuff portion 22 of the sock-like inner shoe body unit (100*a*).

Figure 13:
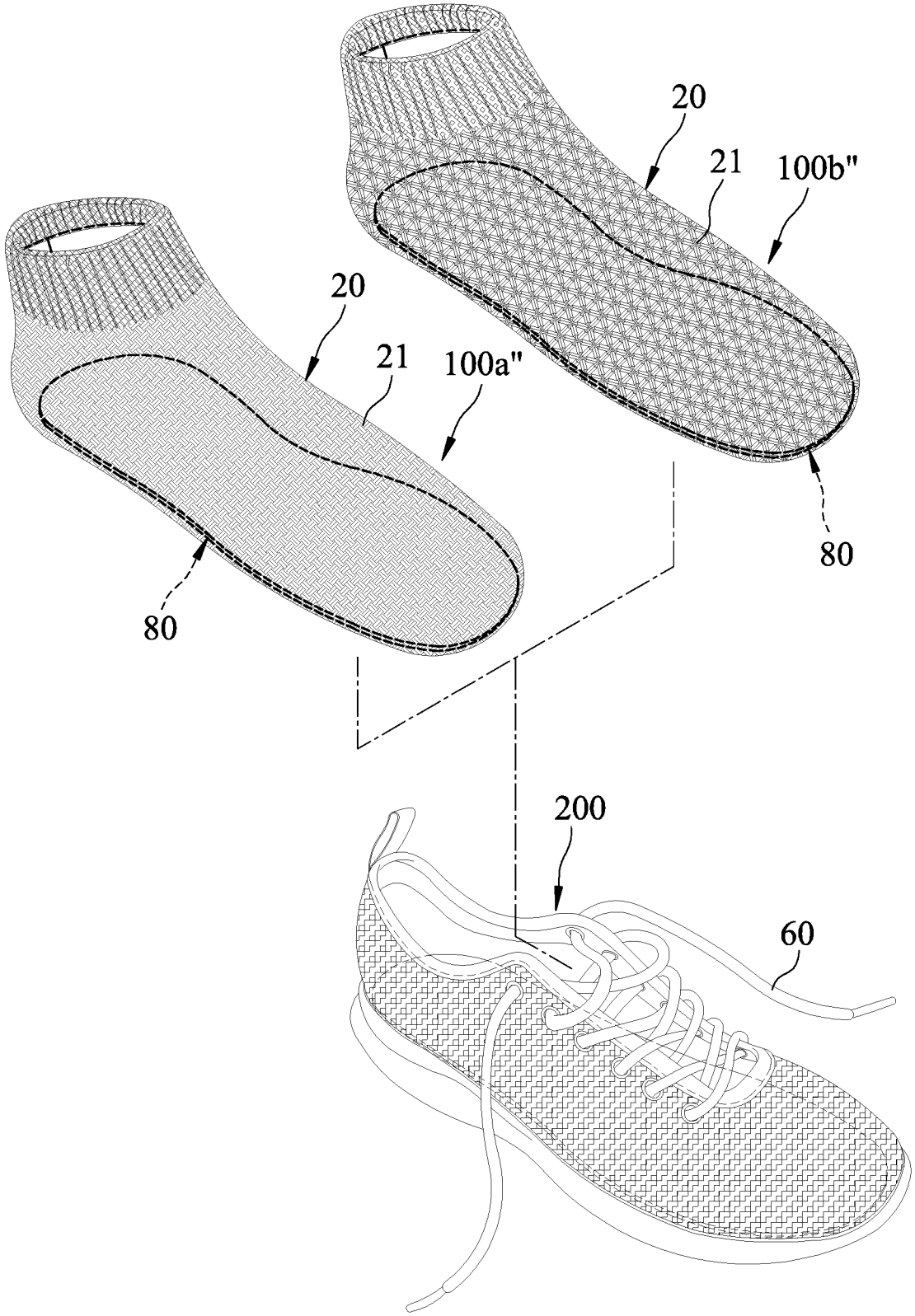
FIG. 13 is an exploded perspective view of an outer shoe body unit and two sock-like inner shoe body units of a moisture-permeable waterproof shoe according to the second embodiment of the present disclosure.
Figure 14:
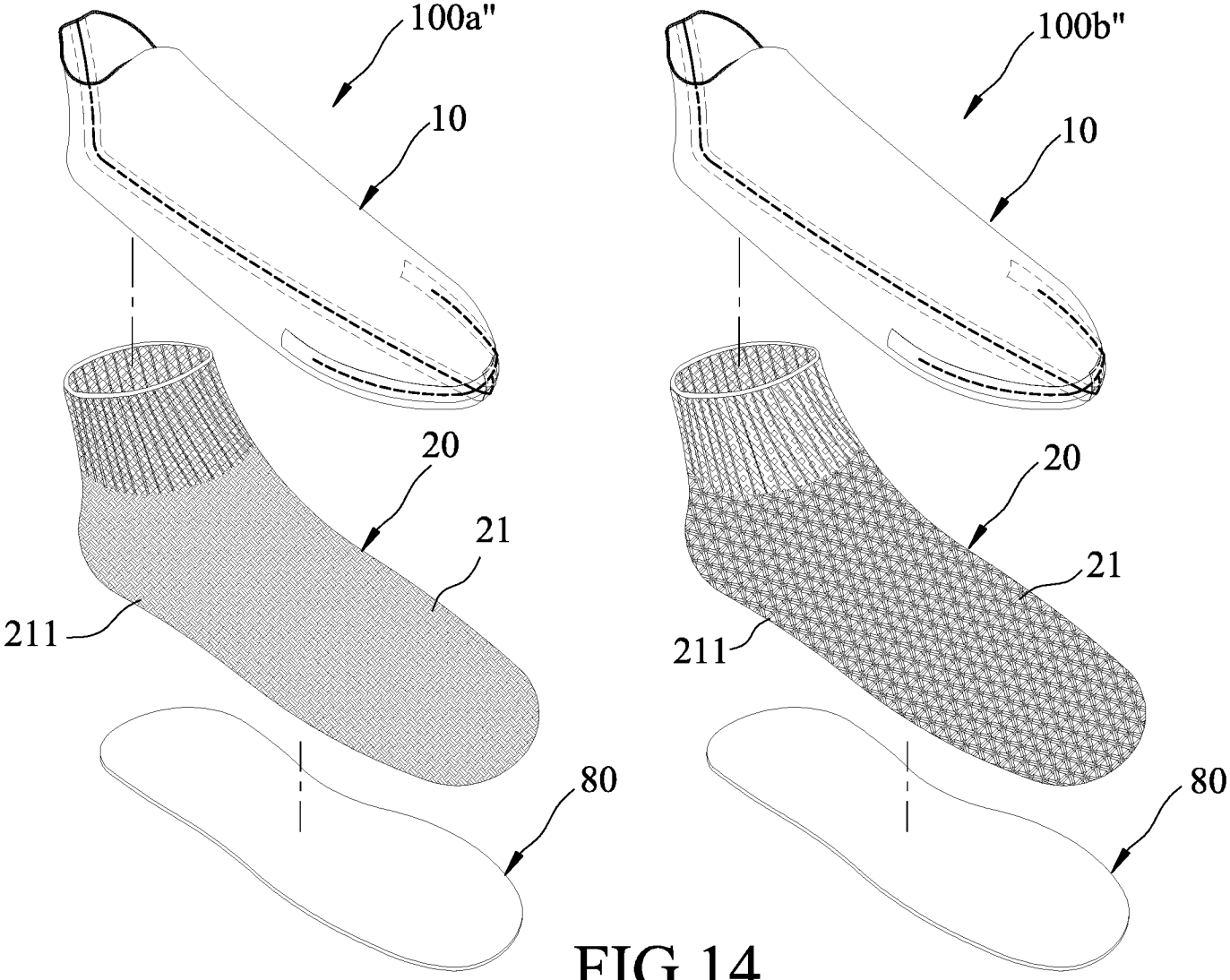
FIG. 14 is an exploded perspective view of each of the sock-like inner shoe body units of the second embodiment.

Referring to FIGS. 13 and 14, the second embodiment of the moisture-permeable waterproof shoe 300 of this disclosure is shown to be similar to the first embodiment. However, in this embodiment, the outer sock body 20 has a bottom surface 211, and each of the sock-like inner shoe body units (100*a*", 100*b*") further includes a thin sole 80 fixedly connected to the bottom surface 211 of the outer sock body 20. The thin sole 80 has a thickness of 2 to 3 mm, and is made of a material having waterproof and slip-resistance function. In this embodiment, the thin sole 80 is made of rubber.

Apart from achieving the same effect as that of the first embodiment, the second embodiment can further permit the user to walk around indoor through the sock-like inner shoe body unit (100*a*", 100*b*") after the moisture-permeable waterproof shoe 300 is removed.

Therefore, the object of this disclosure can indeed be achieved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A multi-style moisture-permeable waterproof shoe comprising:

an outer shoe body unit defining an insertion space that has an open top end and a closed bottom end; and a plurality of sock-shaped inner shoe body units inserted removably and selectively into said insertion space of said outer shoe body unit, each of said sock-shaped inner shoe body units including a moisture-permeable waterproof shoe-shaped inner sleeve, an outer sock body and an inner adhesive layer, said moisture-permeable waterproof shoe-shaped inner sleeve defining a foot space that has an open top end and a closed bottom end and being made from at least one cut piece, said outer sock body having a sock body portion sleeved on said moisture-permeable waterproof shoe-shaped inner sleeve, said inner adhesive layer being adhered between an outer surface of said moisture-permeable waterproof shoe-shaped inner sleeve and an inner surface of said sock body portion;

wherein said at least one cut piece includes a lining layer, an outer fabric layer, an upright velvet layer and a moisture-permeable waterproof layer, said upright velvet layer having a plurality of spaced-apart pile yarns woven between said lining layer and said outer fabric layer; and wherein said outer sock body further has a cuff portion that is elastic and that extends upwardly from a top end of said sock body portion, that is then folded inwardly and downwardly over a top peripheral portion of said moisture-permeable waterproof shoe-shaped inner sleeve toward said foot space of said moisture-permeable waterproof shoe-shaped inner sleeve, said cuff portion being fixed to said lining layer and defining an entry opening communicating with said foot space.

2. The multi-style moisture-permeable waterproof shoe as claimed in claim 1, wherein said cuff portion is sewn to said lining layer.

3. The multi-style moisture-permeable waterproof shoe as claimed in claim 1, wherein:

said at least one cut piece has a main body, and two wing portions symmetrically disposed on two opposite sides of said main body and integrally connected as one piece with said main body, said main body having a front convex portion and a rear concave portion opposite to said front convex portion, each of said front convex portion and said rear concave portion having two opposite ends, each of said wing portions including a wing lateral edge spaced apart from said main body and having a front end and a rear end, a front curved edge connected between said front end of said wing lateral edge and a corresponding one of said two opposite ends of said front convex portion, and a rear mating edge connected between said rear end of said wing lateral edge and a corresponding one of said two opposite ends of said rear concave portion, said front curved edges of said wing portions being connected to a periphery of said front convex portion of said main body, said wing lateral edges of said wing portions being connected to each other, said rear mating edges of said wing portions being connected to each other;

said moisture-permeable waterproof layer serves as said outer surface of said moisture-permeable waterproof shoe-shaped inner sleeve; and each of said sock-shaped inner shoe body units further includes a waterproof unit, said waterproof unit including a first waterproof strip and two second waterproof strips, said first waterproof strip being fixedly connected to and covering said outer surface of said moisture-permeable waterproof shoe-shaped inner sleeve at a position corresponding to the junction of said wing lateral edges and the junction of said rear mating edges, each of said second waterproof strips being fixedly connected to and covering said outer surface of said moisture-permeable waterproof shoe-shaped inner sleeve at a position corresponding to the junction of said front curved edge of each of said wing portions and said periphery of said front convex portion, said second waterproof strips interlacing with a front end of said first waterproof strip.

4. The multi-style moisture-permeable waterproof show as claimed in claim 1, wherein said outer shoe body unit includes an outer shoe upper, and a midsole and an outsole fixed to a bottom end of said outer shoe upper, said outer shoe upper and said midsole cooperating with each other to define said insertion space, said outer shoe upper having an ankle opening edge and a bottom opening edge, said insertion space having an insertion opening surrounded by said ankle opening edge, said bottom opening edge extending to a bottom surface of said midsole and being sewn to said midsole, said outsole being fixed to said bottom opening edge of said outer shoe upper and said bottom surface of said midsole.

5. The multi-style moisture-permeable waterproof show as claimed in claim 4, wherein said outer shoe upper further has an instep edge connected to said ankle opening edge, and said insertion space further has an instep opening surrounded by said instep edge and communicating with said insertion opening.

6. The multi-style moisture-permeable waterproof show as claimed in claim 5, wherein said outer shoe body unit further includes a shoelace and an outer adhesive layer, said outer shoe upper further having a plurality of lace holes arranged in pairs on two opposite sides of said instep edge, said shoelace being removably threaded through said lace holes, said outer adhesive layer being adhered between said bottom opening edge of said outer shoe upper and a top surface of said outsole and between said bottom surface of said midsole and said top surface of the outsole.

7. The multi-style moisture-permeable waterproof show as claimed in claim 1, wherein said multi-style moisture-permeable waterproof shoe comprises two said sock-shaped inner shoe body units.

8. The multi-style moisture-permeable waterproof show as claimed in claim 7, wherein a weave pattern of said outer sock body of one of said sock-shaped inner shoe body units is different from a weave pattern of said outer sock body of the other one of said sock-shaped inner shoe body units.

9. The multi-style moisture-permeable waterproof shoe as claimed in claim 7, wherein a height of said cuff portion of one of said sock-shaped inner shoe body units is different from a height of said cuff portion of the other one of said sock-shaped inner shoe body units.

10. The multi-style moisture-permeable waterproof show as claimed in claim 1, wherein said outer sock body has a bottom surface, and each of said sock-shaped inner shoe body units further includes a thin sole fixedly connected to said bottom surface of said outer sock body.

* * * * *